US008794155B1

(12) United States Patent
Calvert

(10) Patent No.: US 8,794,155 B1
(45) Date of Patent: Aug. 5, 2014

(54) HOLLOW POINT PAYLOAD CAPSULES

(71) Applicant: HP Associates, Trustee for HPCC CRT Trust, Manassas, VA (US)

(72) Inventor: S. Mill Calvert, Manassas, VA (US)

(73) Assignee: HP Associates, Manassas, VA (US), Trustee for HPCC CRT Trust ( * ) Notice: Subject to any disclaimer, the term of this patent is extended or adjusted under 35 U.S.C. 154(b) by 0 days.

(21) Appl. No.: 14/051,821

(22) Filed: Oct. 11, 2013

(51) Int. Cl.
*F42B 5/02* (2006.01)

(52) U.S. Cl.
USPC ..... 102/512; 102/502; 102/439; 102/513

(58) Field of Classification Search
USPC ..... 102/512, 502, 438, 439, 513
See application file for complete search history.

(56) References Cited

U.S. PATENT DOCUMENTS 3,972,286 A 8/1976 Canon
3,980,023 A * 9/1976 Misevich ..... 102/502
4,913,054 A 4/1990 Petersen
7,143,699 B2 12/2006 Brock
7,213,519 B2 * 5/2007 Wiley et al. ..... 102/467
2006/0075919 A1 * 4/2006 Wiley et al. ..... 102/464

OTHER PUBLICATIONS

Sage Control Ordinance Inc., Model BP45, 40MM Baricade Penetrating Projectile, specifications, published online at http: // www.sageinternationalltd.com/SCOI/specs/SCOI_SpecSheet_BP45.pdf, downloaded Oct. 10, 2013.

* cited by examiner

*Primary Examiner* — Michael David
(74) *Attorney, Agent, or Firm* — Louis Ventre, Jr.

(57) ABSTRACT

A system includes an incomplete cartridge for a firearm and a field-selectable capsule for the cartridge. The capsule contains a product that may tag a person for tracing, induce sleep, cause disease, or have other effects. Capsules are preferably removably adhered to a strip with each strip of capsules potentially serving a different purpose. The incomplete cartridge includes a bullet that has an opening at the payload end. The opening receives and retains a capsule upon insertion. The capsule is made of a frangible material that releases the product upon impact. The capsule may be formed with a snap-in ridge extending from its exterior wall, which snaps into a complementary recess in the bullet opening. Alternatively, the capsule may be coated with a contact adhesive so that it sticks to the bullet wall defining the opening. A peel-off covering atop the strip shields the contact adhesive from contamination.

4 Claims, 2 Drawing Sheets

HOLLOW POINT PAYLOAD CAPSULES

TECHNICAL FIELD

In the field of ammunition and explosives, an incomplete cartridge for a firearm that can be loaded in the field with one of a variety of capsules containing an incapacitating, fatal or marking agent for delivery to a target.

BACKGROUND ART

In the War on Terror and other military and law enforcement actions, there often arise specific situations that require specific equipment to deal with, and there may only be a short time frame of either seconds or minutes within which to have this equipment to deal with the situation. The Hollow Point Payload Capsule gives the soldier or police officer the ability to instantly modify his ammunition to accomplish the task at hand. He can instantly insert the needed capsule to deal with the situation.

If the Special Forces need intelligence from a terrorist and do not want him dead, they can insert a sleeping agent and shoot him with a minor flesh wound. When the Hollow Point Payload Capsule goes into a body, the solution inside will go all over the wound damage and be absorbed into the blood stream. The terrorist would then fall asleep and could easily be picked up for intelligence.

With a deadly poison the Hollow Point Payload Capsule, even the smallest round such as a .22, can be a fatal one shot one kill, no matter where the bullet hits. Special Forces can also decide to insert a Hollow Point Payload Capsule with a sickness disease agent so the terrorist goes back to the hideaway with all the other terrorists and makes the whole lot of them very sick. There is no limit to the type of solution particles that can be put inside the Hollow Point Payload Capsule. Some of the common agents maybe: tranquilizer, poison, nerve sickness, sleeping, infection, disease, radioactive, drugs, vaccines, identity markers, radiofrequency identification chips, etc.

The capsules may be semi-rigid or may be pliable to mold and fit into different openings in the bullet. There can be a variety of different capsule sizes. There may be one size that fits into any common size pistol bullet. There could be a tiny size made to fit into small rounds such as .22 caliber. There may be a size made to fit into riffle bullets for snipers.

SUMMARY OF INVENTION

A system includes an incomplete cartridge for a firearm and a field-selectable capsule for the cartridge to complete the cartridge in the field. The capsule contains a product that may tag a person for tracing, induce sleep, cause disease, or have other effects. The capsules are preferably removably adhered on a strip with each strip of capsules potentially serving a different purpose. The incomplete cartridge includes a bullet that has an opening at the payload end. The opening is structured to receive and retain one of the capsules when the payload end is pressed against the capsule on the strip. The capsule is made of a frangible material that releases the product after impact of the bullet once fired from the weapon. The capsule may be formed with a snap-in ridge extending from its exterior wall. The ridge snaps into a complementary recess in the bullet opening. Alternatively, the capsule may be coated with a contact adhesive so that it sticks to the bullet wall defining the opening. A peel-off covering atop the strip shields the contact adhesive on the plurality of capsules.

Technical Problem

There is a need for a cartridge that is quickly field-finished to suit a variety of tactical environments and fluid objectives faced by Special Forces and tactical police teams. While cartridges exist to increase the lethality of a hit, none permit changes to the cartridge in the field to accomplish shifting objectives and perhaps more than increased lethality, such as inducing sleep to promote capture, causing contagious infection to spread its incapacitating effect to a terrorist group, or tagging so that the target can be tracked to a lair.

Solution to Problem

The solution is an incomplete cartridge for a firearm that is completed in the field with a capsule selected from a variety of capsules serving potentially diverse goals to meet potentially shifting field conditions faced by Special Forces and tactical police teams.

Advantageous Effects of Invention

The Hollow Point Payload Capsule could make any sniper hit a lethal kill even if the terrorist was hit with a flesh wound.

Different strips of capsules would be labeled and color coded so the soldier could instantly see and utilize the specific payload he needs.

With the Hollow Point Payload Capsule, the soldier or law enforcement officer would be able to instantly change his rounds to a job-specific round to accomplish his objective.

The Hollow Point Payload Capsule will help to save the lives of our brave law enforcement personnel and soldiers and help them to accomplish their missions so that America can remain the land of the free.

BRIEF DESCRIPTION OF DRAWINGS

The drawings illustrate preferred embodiments of the hollow point payload capsules according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
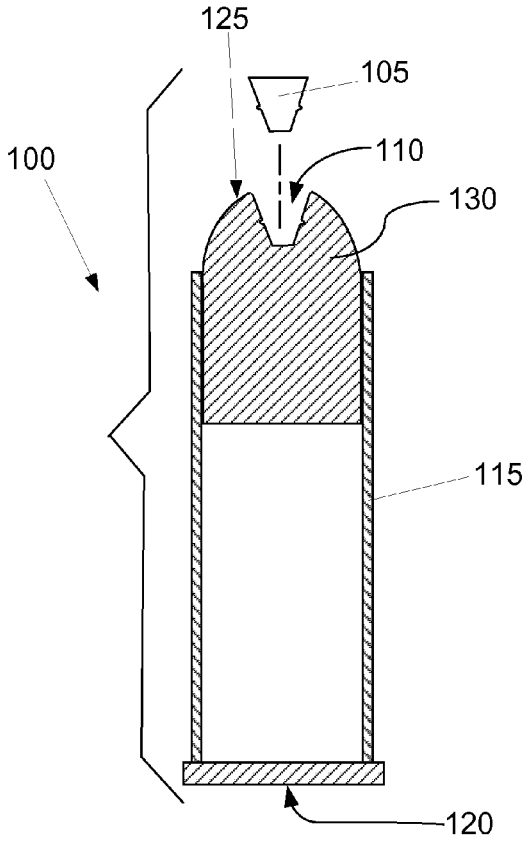
FIG. 1 is an exploded elevation view of the system showing a sectional view of an incomplete cartridge and a side view of a capsule in a first embodiment.
Figure 8:
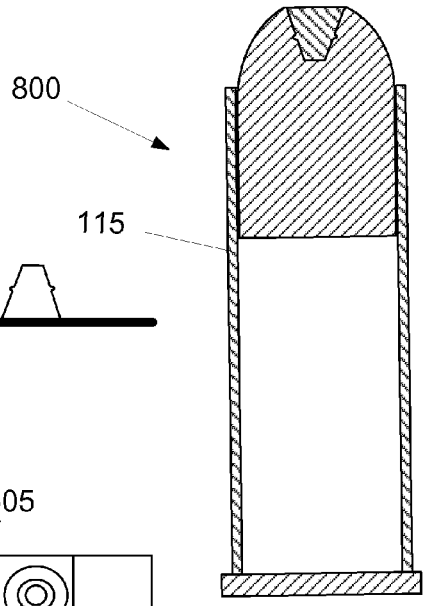
FIG. 8 is a sectional elevation view of a loaded and complete cartridge.

FIG. 1 illustrates an exploded elevation view of a system (100) comprising an incomplete cartridge (115) and a field-selectable payload. The field-selectable payload comprises a bullet (130) and a capsule (105) containing a product (415). The field-selectable payload is loadable in the incomplete cartridge (115) to make a loaded and complete cartridge (800), shown in FIG. 8. The field-selectable payload is deliverable to a target once it is loaded in the incomplete cartridge (115) and the loaded and complete cartridge (800) is fired from a firearm.

Thus, the field-selectable payload is a capsule (105) within a bullet (130). The capsule (105) contains a product (415), which may be a liquid, solid or gaseous material.

FIG. 1 shows a sectional view of the incomplete cartridge (115) and a side view of the capsule (105) in a first embodiment. The capsule (105) in this example has a hexagonal structure.

Figure 2:
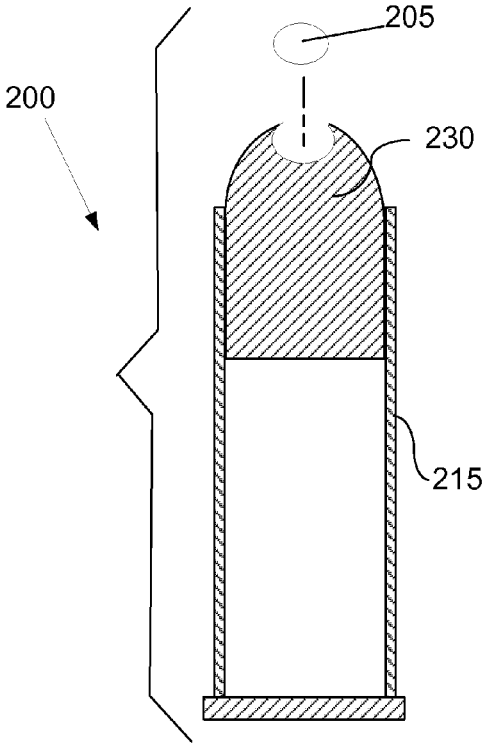
FIG. 2 is an exploded elevation view of an alternative embodiment of the system showing a sectional view of a second bullet and a side view of a second capsule in a second embodiment.

FIG. 2 is an exploded elevation view of a second system (200) which is an alternative embodiment showing a sectional view of a second incomplete cartridge (215) having a second bullet (230) and a side view of a second capsule (205) having an ovate shape.

Figure 3:
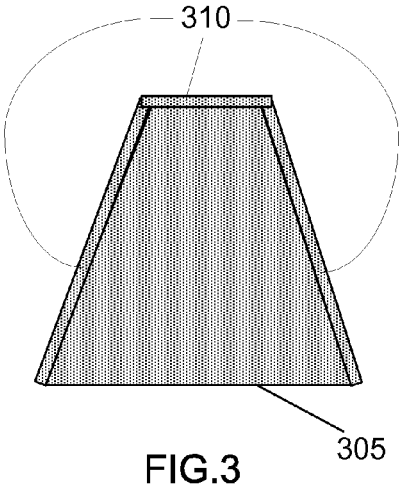
FIG. 3 is a side elevation view of a third capsule with an adhesive coating.

FIG. 3 is a side elevation view of a third capsule (305) with a contact adhesive (310) on all sides except the surface at the wide bottom as oriented in that figure, which is what would be exposed to the air once inserted into the opening (110). The third capsule (305) does not have a snap-in ridge (405). As may be envisioned by the examples of FIGS. 1-3, the capsule may have any volumetric shape capable of containing the product (415).

Figure 4:
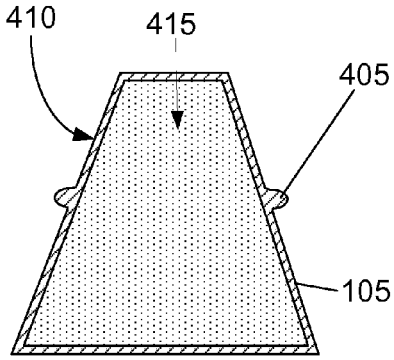
FIG. 4 is a sectional elevation view of the capsule showing a snap-in ridge and the product inside.

FIG. 4 is a sectional elevation view of the capsule (105) of FIG. 1 showing a snap-in ridge, an exterior wall (410) and the product (415) inside, as represented by the speckling.

The incomplete cartridge (115) comprises the bullet (130). The incomplete cartridge (115) has a firing end (120) and a payload end (125). The bullet (130) is within the incomplete cartridge (115) at the payload end (125). The payload end (125) of the bullet (130) defines an opening (110), which is preferably in a shape that is complementary to the capsule (105) so that the capsule can be added to the bullet (130) in the field by a shooter and when so added preferably completes the shape of the bullet (130).

The system preferably includes a plurality of capsules and each capsule (105) in the plurality of capsules contains a product (415). The capsule is frangible, that is, it has a structure that breaks apart and releases the product (415) from the bullet (130) after impact of the bullet (130), the bullet (130) having been fired from the firearm.

Figure 5:
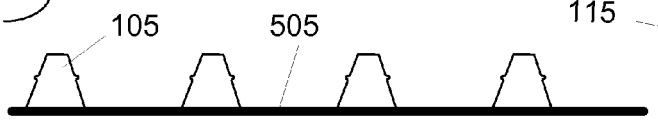
FIG. 5 is a side elevation view of capsules adhered to a strip.
Figure 6:
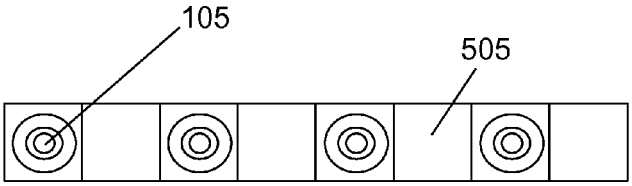
FIG. 6 is a top view of the capsules adhered to the strip.

The system preferably includes a strip (505) removably adhering a plurality of the capsules to the strip (505). Thus, multiple capsules are preferably removably adhered on a strip (505), so that they can easily be added to a bullet (130) in the field to make a loaded and complete cartridge (800). A soldier or other person may have multiple strips with different products to choose from to suit the mission. FIG. 5 shows an incomplete cartridge (115) situated above the strip (505) in a position ready for pushing the incomplete cartridge (115) onto the capsule (105). FIG. 6 shows a top view of the strip (505) with a plurality of the capsules of FIG. 1.

The capsule (105) is preferably made of a material that is sturdy enough so that it will not fracture when shot out of a gun when present in the opening (110) of a bullet (130), but will fracture into bits, or burst, once impact occurs. A frangible plastic is a preferred example of such material for rigid or semi-rigid capsules that have a snap-in ridge (405). A pliable plastic is preferred for capsules that mold and fit into different sized openings in the bullet (130) and may be retained with contact adhesive (310).

The system (100), therefore, includes an incomplete cartridge (115) and the incomplete cartridge (115) includes a bullet, a firing end (120) and a payload end (125). The payload end (125) defines an opening (110) in the bullet (130). The opening (110) is structured to receive and retain the capsule (105) when the payload end (125) is pressed against the capsule on the strip (505).

The capsule (105) may be shaped with a snap-in ridge (405) that snaps into a complementary recess (510) within the opening (110), or it may be designed to press into the opening (110) so that it forces the opening (110) apart and is thereafter held in place once completely set within the opening (110), or the capsule (105) can be coated in glue, or contact adhesive (310), that adheres to the bullet (130) once the capsule (105) is placed in the opening.

Thus, the system (100) may include a capsule (105) having an exterior wall (410) and a snap-in ridge (405) extending from the exterior wall (410); and wherein the opening (110) has a complementary recess (510) to accept the snap-in ridge (405).

Figure 7:
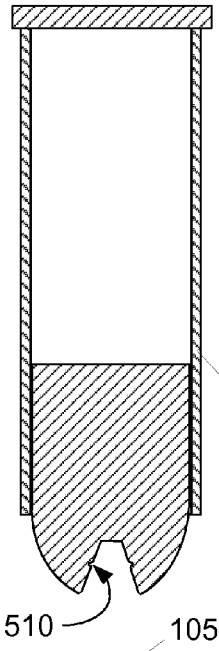
FIG. 7 is a side elevation view of the capsules adhered to the strip and a plastic cover atop the capsules.
Figure 7:
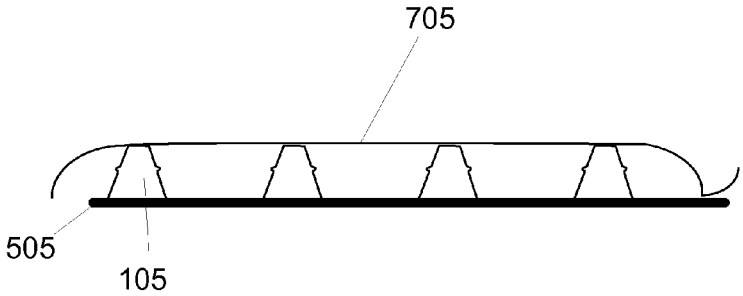

Alternatively, the system (100) may include a capsule (105) having a contact adhesive (310) applied to each capsule (105) in the plurality of the capsules on the strip (505), or to each wall of the capsule that contacts the bullet (130) when the capsule (105) is placed within the opening (110). To protect the glue covered capsules from contamination of the glue, a peel-off covering (705) may be used as shown in FIG. 7. The peel-off covering (705) would then sit atop the strip (505) and consequently shield the contact adhesive (310) on the plurality of the capsules. A shooter would peel back the peel-off covering (705) to gain access to a capsule (105).

Examples of the product (415) within a capsule (105) include a tranquilizer agent, a deadly poison, a nerve agent, a sickness-inducing agent, a sleeping agent, an infectious agent, a disease-causing agent, a dye, a radioactive marker, and a radio frequency identification integrated circuit.

Radio frequency identification integrated circuits are now available in particle size much smaller than a grain of rice, that is, about the 0.4 millimeters square. With a particle size this small and coated with a sticky substance, the product once delivered could mark not only the target but a room full of terrorists with one shot and would be virtually invisible on the terrorists. This product is commercially available in a product called the p-CHIP which uses the frequency of 2.45 GHz. It has a 128-bit ROM for storing the ID with no write-read and no anti-collision capabilities. Its unique ID numbers can be used to individually identify trillions of trillions of objects with no duplication.

In the method of using the system (100), a shooter loads a capsule (105) into a bullet (130) in an incomplete cartridge (115) by pressing the incomplete cartridge (115) onto the capsule (105) that is adhered to a strip (505). The shooter removes the capsule (105) from the strip using the incomplete cartridge (115) as leverage to break the adhesive seal of the capsule (105) on the strip. Once the capsule (105) is loaded into the opening (110) of the bullet (130) and the capsule is no longer on the strip (505), the shooter loads the incomplete cartridge into a gun, aims and fires to deliver the product (415)

to a target. The shooter may carry a variety of strips holding different agents to suit the circumstances so that the bullet and the capsule is a field-selectable payload.

INDUSTRIAL APPLICABILITY

The invention has application to the firearms industry.

What is claimed is:

1. A system comprising an incomplete cartridge and a field-selectable payload, the field-selectable payload loadable in the incomplete cartridge to make a loaded and complete cartridge, the field-selectable payload deliverable to a target when the loaded and complete cartridge is fired from a firearm, wherein the field-selectable payload comprises a bullet and a capsule containing a product;

the system further comprising a strip removably adhering a plurality of the capsules;

wherein the incomplete cartridge comprises the bullet, a firing end and a payload end, the payload end defines an opening in the bullet, the opening is structured to receive and retain the capsule when the payload end is pressed against the capsule on the strip; and said capsule comprising a frangible material that releases the product from the payload end after impact of the bullet having been fired from the firearm.

2. The system of claim 1, wherein the capsule comprises an exterior wall and a snap-in ridge extending from the exterior wall; and wherein the opening has a complementary recess to accept the snap-in ridge.

3. The system of claim 1, further comprising:

a contact adhesive applied to each capsule in the plurality of the capsules; and a peel-off covering atop the strip that shields the contact adhesive on the plurality of the capsules.

4. The system of claim 1, wherein the product is selected from the group consisting of: a tranquilizer agent, a deadly poison, a nerve agent, a sickness-inducing agent, a sleeping agent, an infectious agent, a disease-causing agent, a dye, a radioactive marker, and a radio frequency identification integrated circuit.

* * * * *